US006079396A

United States Patent [19]

Ament et al.

[11] Patent Number: 6,079,396

[45] Date of Patent: Jun. 27, 2000

[54] AUTOMOTIVE COLD START FUEL VOLATILITY COMPENSATION

[75] Inventors: Frank Ament, Troy; David Brian Brown, Brighton, both of Mich.

[73] Assignee: General Motors Corporation, Detroit, Mich.

[21] Appl. No.: 09/069,361

[22] Filed: Apr. 29, 1998

[51] Int. Cl.[7] ..... F02D 41/00

[52] U.S. Cl. ..... 123/674; 123/491; 701/113

[58] Field of Search ..... 123/339.12, 478, 123/491, 674; 701/103, 104, 113

[56] References Cited

U.S. PATENT DOCUMENTS

| | | | |
|---|---|---|---|
| 4,748,959 | 6/1988 | Cook et al. . | |
| 4,905,649 | 3/1990 | Washino et al. | 123/491 |
| 5,343,760 | 9/1994 | Sultan et al. . | |
| 5,351,193 | 9/1994 | Poirier et al. . | |
| 5,419,296 | 5/1995 | Yamaura | 123/491 |
| 5,477,832 | 12/1995 | Visser | 123/491 |
| 5,507,265 | 4/1996 | Ichikawa et al. | 123/491 |
| 5,596,972 | 1/1997 | Sultan et al. . | |
| 5,634,449 | 6/1997 | Matsumoto et al. | 123/491 |
| 5,735,249 | 4/1998 | Parke et al. | 123/491 |

*Primary Examiner*—Erick R. Solis
*Attorney, Agent, or Firm*—Michael J. Bridges

[57] ABSTRACT

Automotive internal combustion engine fuel volatility is estimated during cold start operations by stabilizing air admission to the engine and analyzing engine speed over a modeling period following an engine coldstart after engine speed has stabilized and prior to closed-loop engine operation. If engine speed deviates significantly away from an expected engine speed for the current engine intake air and fuel, a fuel volatility deviation is diagnosed. The magnitude of the fuel volatility deviation away from a nominal fuel volatility is determined as a function of the magnitude of the engine speed deviation. A fuel volatility correction value is updated as a function of the engine speed deviation and is applied throughout an ignition cycle, including during the modeling period to compensate for the fuel volatility deviation.

5 Claims, 2 Drawing Sheets

AUTOMOTIVE COLD START FUEL VOLATILITY COMPENSATION

TECHNICAL FIELD

This invention relates to internal combustion engine control and, more particularly, to engine control responsive to estimated fuel volatility.

BACKGROUND OF THE INVENTION

To further reduce automotive vehicle emissions, substantial effort is being made to warm up catalytic treatment devices more quickly and to control engine air/fuel ratio close to stoichiometry following a vehicle cold start. To meet certain emissions reduction goals, the exhaust stream from an engine to the catalytic treatment device must be substantially at stoichiometry or leaner within seconds following a cold start. Providing a stoichiometric mixture of fuel and air within the combustion chamber of the engine requires good fuel injection control and tightly controlled fuel characteristics. Fuel injection control precision is improving. However, mid-range volatility of commercial fuel—a critical fuel characteristic for exhaust stream air/fuel ratio control—can be highly variable depending on such factors as the geographical region, the season, and the feedstock. Accordingly, to ensure acceptable cold start driveability, the calibration used in engine air/fuel ratio control must be biased fuel rich of stoichiometry to anticipate a worst case Driveability Index (volatility) fuel. Such a calibration results in fuel rich engine operation during most conditions and use of a secondary air injection system in an vehicle exhaust system to enlean the engine exhaust to provide the required lean air-fuel stream to the catalytic treatment device. The secondary air injection system adds significantly to the cost and complexity of the vehicle. It would therefore be desirable to provide for a stoichiometric mixture of fuel and air within the combustion chamber of the engine shortly after an engine coldstart over a range of mid-range fuel volatility without the cost and complexity associated with secondary air injection systems.

It has been proposed to measure fuel volatility following a refueling operation by monitoring hydrocarbons in a fuel vapor control system over a period of time following the re-fueling operation as disclosed in copending U.S. patent application Ser. No. 08/948,501, filed Oct. 10, 1997, assigned to the assignee of this application. Engine air/fuel ratio control is then adjusted following the monitoring period to provide for improved air/fuel ratio control, including control of the air/fuel ratio of engine exhaust gasses passing to the catalytic treatment device. The shortcoming of this approach is that the air/fuel ratio in the exhaust stream to the catalytic treatment device may be difficult to precisely control during the monitoring period, which may be of significant duration.

Accordingly, it would be desirable to rapidly estimate fuel volatility following a re-fueling operation so that fuel control may be promptly adjusted in response thereto to provide for accurate control of the air/fuel ratio in the engine exhaust stream to the catalyst.

SUMMARY OF THE INVENTION

The present invention is directed to a desirable improvement over conventional engine controls through a rapid estimation of fuel volatility at engine start-up and through prompt adjustment of engine air/fuel ratio control in response to the estimated fuel volatility for accurate, timely stoichiometric air/fuel ratio control following engine cold-start operations.

More specifically, cold start engine speed during engine idle operations is used to indicate fuel volatility. The speed of a cold-started engine is dependent on the amount of fuel vapor available from the middle of the fuel distillation curve. Therefore, engine speed for a given quantity of delivered liquid fuel can be used as a fuel volatility indicator. Engine speed is a result of power generated in the engine combustion chamber minus internal and external engine loads. If these loads can be controlled or quantified, the engine speed can be used as an indicator of engine power. Under steady engine intake airflow operating conditions, engine speed is monitored in response to fuel changes and modifiers for fuel volatility are determined for subsequent maneuvers. These modifiers can be verified, adjusted and stored as soon as the engine goes closed-loop, which may be within seconds following an engine cold start. Once the fuel volatility is estimated, other conventional methods of supplementing fuel vapor may be implemented. The fuel volatility estimation is applied to adjust engine cylinder fueling commands for successive engine cycles.

In accord with a further aspect of this invention, the fuel volatility estimation is carried out at the start of each vehicle ignition cycle, following a calibrated engine speed stabilization period. The fuel volatility estimation continues until closed-loop engine air/fuel ratio control becomes active. In accord with yet a further aspect of this invention, the fuel volatility estimation compares engine speed to a target engine speed range for given idle speed control conditions. If engine speed exceeds the target engine speed range, then a correction factor representing a required change in engine cylinder fueling to compensate for fuel volatility variation away from a nominal volatility, is reduced. If engine speed is less than the target engine speed range, the correction factor is increased. The correction factor is applied throughout an engine operating cycle to bias engine cylinder fueling commands to compensate for current fuel volatility. In accord with yet a further aspect of this invention, the magnitude of the decrease or increase to the correction factor may be a simple additive offset. In accord with yet a further aspect of this invention, the magnitude may be determined as a function of the engine speed deviation away from the target engine speed range.

BRIEF DESCRIPTION OF THE DRAWINGS

The invention may be best understood by reference to the preferred embodiment and to the drawings in which.

DESCRIPTION OF THE PREFERRED EMBODIMENT

Figure 1:
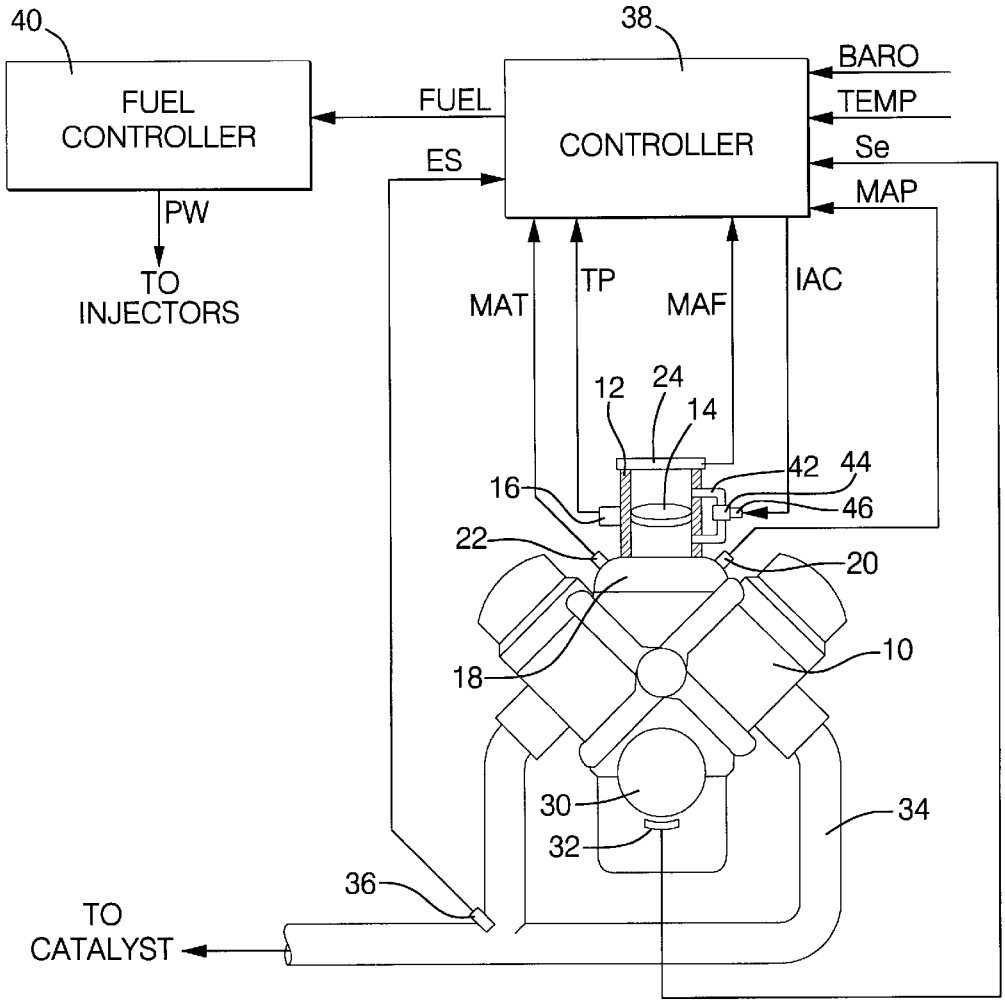
FIG. 1 is a general diagram of an automotive powertrain and a control system for controlling operation of powertrain systems in accordance with the preferred embodiment of this invention.

Referring to FIG. 1, internal combustion engine 10 receives intake air through an intake bore 12 in which is rotatably positioned an intake air valve 14 of the rotary or butterfly type which is manually rotated within the bore 12 to vary restriction to intake air passing through the bore to an intake manifold 18. A mass airflow meter 24 of the thick film or hot wire type is positioned across the bore 12 for transducing the mass flow rate of air passing across the sensor into output signal MAF. A potentiometric position sensor 16 is mechanically linked to the intake air valve 14 to rotate therewith for transducing, in any suitable conventional manner, a degree of rotation of the valve 14 away from a rest position into an output signal TP. A conventional pressure transducer 20 is positioned within the intake manifold 20 for transducing absolute air pressure therein into output signal MAP. A temperature sensor 22 in the form of a thermocouple or thermistor of suitable conventional design is disposed within the intake manifold 20 for transducing the air temperature therein into output signal MAT.

Bypass passage 42 in the form of a closed conduit opens into the intake air bore 12 on its first end at a position upstream, according to the normal direction of airflow through the bore 12, of the intake air valve 14 and opens on a second end opposing the first end downstream, according to the normal direction of airflow through the bore 12, of the intake air valve. The bypass passage serves as an engine inlet air passage bypassing the intake air valve 14. A bypass valve 44 taking the form of an electronically controlled solenoid valve or any suitable conventional engine inlet air valve is positioned within the bypass passage 42 and is mechanically coupled, such as through a conventional geartrain, to an actuator 46 of the stepper motor type in this embodiment. The actuator 46 is electronically driven in response to a control signal IAC applied thereto in the form of a drive current, to vary the position of the bypass valve 44 within the bypass passage 42 and thereby vary restriction to airflow through the bypass passage during idle operating conditions as are understood in the art to which this invention pertains to include conditions of relatively low engine speed, such as below one thousand r.p.m., and intake air valve in its rest (maximum airflow restriction) position within the bore 12.

A fuel controller 40 in the form of conventional fuel injector driver circuitry receives a fuel injection command FUEL indicating a desired fuel injection quantity for a next active engine cylinder and generates a drive signal PW in the form of a injector drive pulse of duration corresponding to the duration an injector for a next active cylinder (next cylinder undergoing a fuel injection event) is to open to allow pressurized fuel to pass therethrough to an intake runner (not shown), opening across an intake valve (not shown) into the next active cylinder, in accordance with fuel control practices well-known in the engine control art.

The intake air passing to the intake manifold 18 distributed to a plurality of engine cylinder intake runners (not shown) where it is combined with injected fuel forming an air-fuel mixture. The air-fuel mixture is selectively admitted to engine cylinders (not shown) for combustion therein. The combustion process drives pistons (not shown) within the cylinders in a reciprocal manner. The pistons are linked to an engine output shaft 30 such as a crankshaft to rotationally drive the crankshaft which is coupled to driven vehicle wheels (not shown) for driving a corresponding automotive vehicle (not shown).

A sensor 32 taking the form of a Hall effect, variable reluctance, or magnetoresistive sensor in this embodiment is secured to the engine 10 in a fixed position relative to the output shaft 30 in proximity to a plurality of spaced teeth or notches (not shown) machined about the circumference of the output shaft 30. As the shaft rotates, the teeth or notches pass in proximity to the sensor 32 and disrupt a field, such as of the electromagnetic type, generated about the sensor. The field disruption measurably and predictably varies the impedance of the sensor 32 which appears as a variation in sensor output signal Se. The teeth or notches about the circumference of the output shaft 30 are spaced such that the rate of rotation of the shaft 30 (generally referred to as engine speed) may be determined from the frequency of the signal Se, as is generally known in the art. Certain engine cylinder events may further be diagnosed from the character of the signal Se, including cylinder top dead center events.

Exhaust gasses produced in the cylinder combustion process are guided out of the cylinders through an exhaust gas passage 34 to a catalyst of a catalytic treatment device (not shown) for catalytic treatment therein. An exhaust sensor 36 taking the form of a suitable conventional zirconia oxide oxygen sensor or a linear air/fuel ratio sensor is disposed within the exhaust gas passage to transduce, upon reaching an operating temperature, the oxygen concentration or, for the linear air/fuel ratio sensor, the air/fuel ratio, within the exhaust gas passing thereby into output signal ES. As is generally understood in the art, the exhaust sensor 36 becomes active a period of time following an engine cold-start. This period of time is estimated in this embodiment and action taken in response to the estimation, as will be described in FIG. 2. Any of a variety of suitable conventional approaches to estimating when the exhaust sensor 36 becomes active following an engine coldstart may be employed in this embodiment. For example, a timer may be initiated following a coldstart. When the timer reaches a calibrated time threshold, the sensor 36 may be assumed to be active. Alternatively, the sensor output signal ES may be monitored and the sensor 36 assumed to be active when the peak-to-peak variation in the amplitude of ES exceeds a calibrated variation. A temperature sensor (not shown), such as a conventional thermocouple or thermistor is positioned within an engine coolant circulation path (not shown) for transducing the temperature of the coolant, as an indication of engine temperature, into output signal TEMP.

An engine controller 38 includes such well-known elements (not shown) as a central processing unit, read only memory devices (ROM) for long term data storage and retrieval, random access memory devices (RAM) for temporary, rapid data storage and retrieval, and input/output devices (I/O) for managing receipt of such input signals as MAP, TP, ES, MAT, MAF, Se, TEMP, and BARO, and for transmitting output signals for providing control and diagnostics operations, including signals IAC for driving the actuator 46, FUEL for driving the fuel controller 40, and ignition drive signals for controlling cylinder ignition timing.

A series of operations implemented in the form of step by step software instructions stored in ROM (not shown) of the controller 38 are periodically executed by the controller 38 to provide for such control and diagnostic operations as are generally understood in the art. Such operations include the operations illustrated in FIG. 2 which are executed following a cold start of the engine 10 of FIG. 1. A cold start (also referred to herein as a coldstart) is generally recognized as a startup operation of an engine that has been inoperative for a period of time sufficient that certain critical components, such as exhaust sensors (such as sensor 36 of FIG. 1) and catalytic treatment devices are at a temperature below that capable of sustaining catalytic activity therein. Accordingly, for a period of time following such a cold start, the engine air/fuel ratio control will operate in an open-loop control mode until those critical components are warmed up through engine cylinder combustion energy transfer thereto, to assure reliable feedback information indicating actual engine air/fuel ratio.

Figure 2:
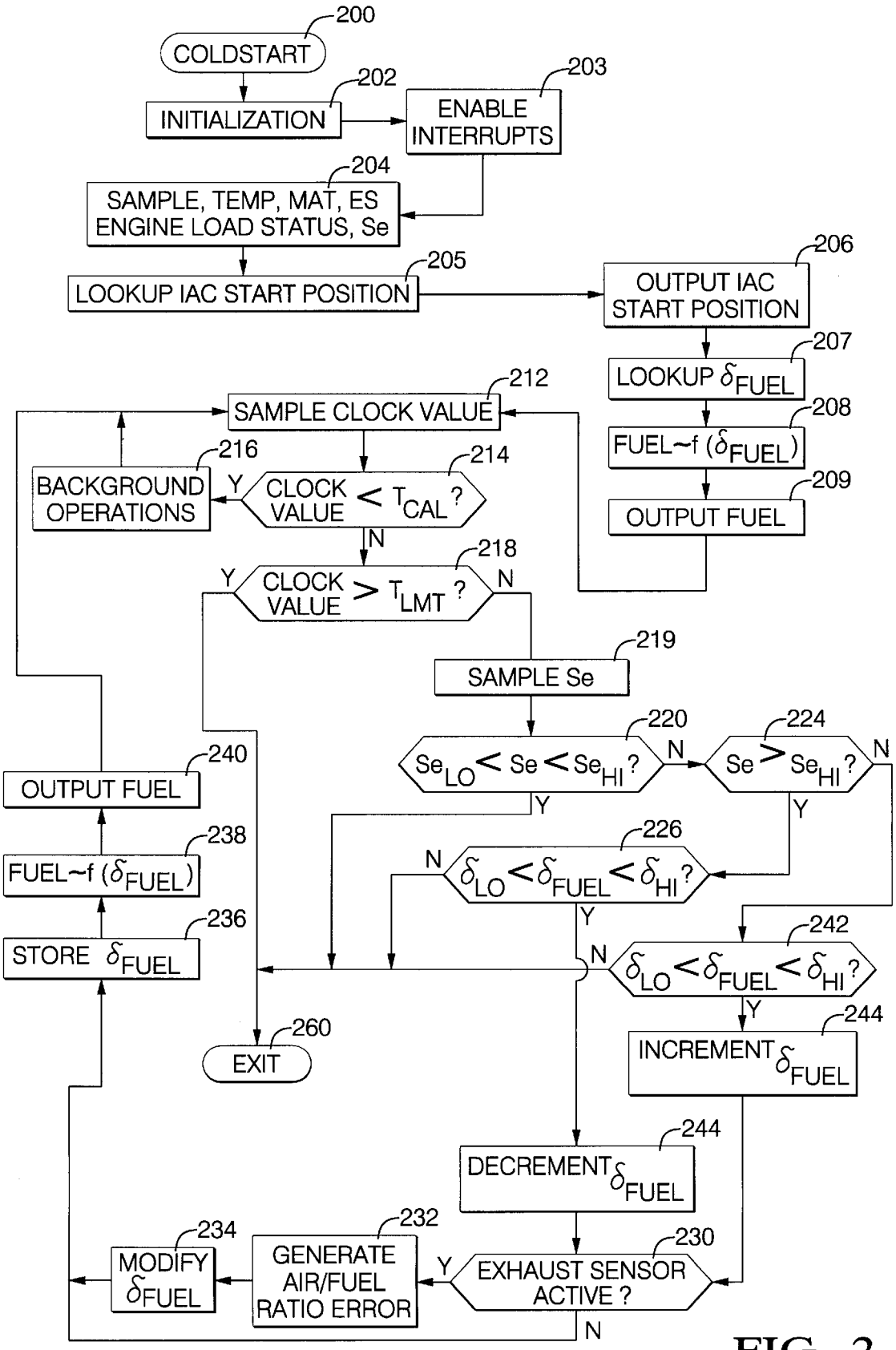
FIG. 2 is a computer flow diagram illustrating a flow of operations of the control system of FIG. 1.

The operations of FIG. 2 provide for initialization and control operations for a calibrated period of time following such a cold start to provide for control of fuel and air to cylinders of the engine 10 of FIG. 1 in response to an estimate of fuel volatility, for accurate engine air/fuel ratio control in accordance with this invention. Following the calibrated period of time, closed-loop control operations will be carried out which inherently adjust for such factors as fuel volatility on air/fuel ratio control through well-known closed-loop control techniques.

More specifically, upon initiation of a coldstart operation, such as when an operator of the engine 10 of FIG. 1 rotates an ignition cylinder to an "on" position following an extended period of latency, the operations of FIG. 2 are initiated at a step 200 and proceed to carry out general initialization operations at a next step 202. Such initialization operations include clearing memory location, transferring constants from read only memory locations to random access memory location, setting initial values to pointers and counters and other generally known initialization procedures. Following such initialization procedures, a plurality of interrupts are enabled at a next step 203 including timer based and event based interrupts for carrying out generally known control, maintenance and diagnostic operations. After enabling such interrupts, a plurality of controller input signals are sampled at a step 204 indicating current engine parameter values, including signals TEMP, MAT, ES, Se, and a number of flags indicating engine load status, such as flags indicating whether an air conditioning clutch (not shown) is engaged, whether a power steering pump load is currently being applied, and alternator field control status.

Following the sampling of the input signals, an idle air control (IAC) start position is referenced from a predetermined storage location in a controller 38 (FIG. 1) memory device, such as a read only memory device, at a step 205. The start position is a calibrated initial coldstart position of a bypass valve actuator, such as actuator 46 (FIG. 1) that is adapted through execution of the operations of FIG. 2, as will be further detailed. The IAC start position is next output to the bypass valve actuator 46 (FIG. 1) at a next step 206 in the form of an actuator command of a form providing for driving the actuator 46 to a desired start position to provide for a desired degree of restriction to airflow past the bypass valve 44 (FIG. 1). This desired degree of restriction is maintained throughout the process of estimating fuel volatility as described through the operations of FIG. 2, to provide a stable operating environment so that accurate fuel volatility estimation may be provided. A fueling correction factor $\delta_{FUEL}$ representing a fuel volatility-based correction of a fueling command is next referenced from a storage location, such as in a controller random access memory device (not shown) at a step 207. A fueling command FUEL is next generated in response to the correction factor and the degree of opening of the bypass valve 44, at a step 208. The command FUEL represents a current desired fueling command determined from a base command, such as an open-loop command coordinated with the current degree of opening of the bypass valve 44. The base command is stored in a controller read only memory device and established through conventional calibration procedures. The base command is corrected in this embodiment by applying the correction factor $\delta_{FUEL}$ thereto, such as in the form of an additive or multiplicitive correction factor. The command FUEL is next output to the fuel controller 40 of FIG. 1 at a step 209 to provide for initial coldstart fueling control in accord with this embodiment. The relative stability of the air and fueling commands as provided through the steps 205–209, provide a relatively stable environment in which a relationship between engine speed and fuel volatility may be understood, by applying engine speed information to a fuel volatility model, as will be further detailed.

Figure 3:
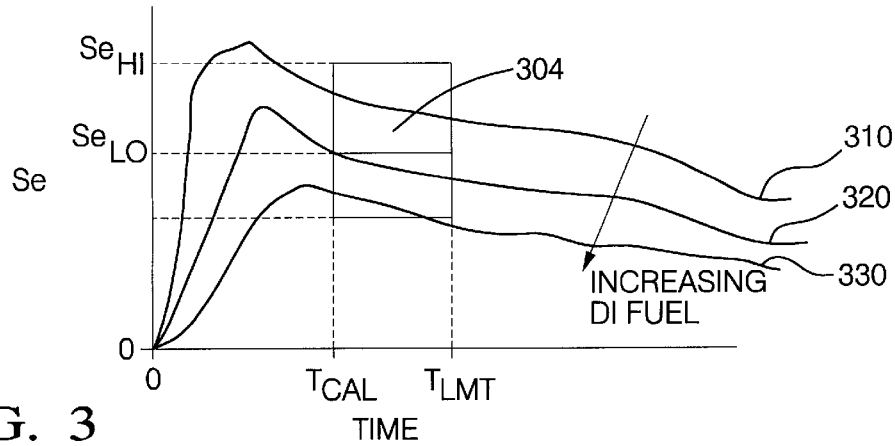
FIG. 3 is a graphical diagram illustrating a relationship between fuel volatility and engine speed as applied in the operations of FIG. 2.

A clock value is next sampled at a step 212 indicating the elapsed time since the start of the cold start operations. For example, the current count of a standard free running counter of the controller 38 may be sampled at the step 212, with the counter reset to zero during the described initialization operations of step 202 of FIG. 2. The clock value sampled at the step 212 is next compared, at a step 214, to a calibrated time value Tcal, set to about two seconds in this embodiment, as the amount of time required, following the startup of the engine 10 of FIG. 1 until engine speed has stabilized to an extent allowing estimation of fuel volatility in response thereto, as will be further detailed. FIG. 3 illustrates the substantial engine speed variation for a period of time up after a startup (at time t=0) until time Tcal during which time engine speed is determined to not be a reliable indicator of fuel volatility.

More specifically, if the clock value is determined to be less than Tcal at the step 214, engine speed is assumed to not yet be sufficiently stable to allow for fuel volatility compensation operations, and background operations are accordingly carried out at a next step 216, including conventional control, diagnostic, communications and maintenance operations of a relatively low priority. Following such background operations, the clock value is again sampled at the step 212 and compared to Tcal at the step 214. This loop continues until the clock value exceeds Tcal, at which time the clock value is next compared, at a step 218, to a calibrated time limit value Tlmt, set to about thirty seconds in this embodiment, and representing the amount of time prior to a high fuel vaporization operating condition caused by a significant increase in engine operating temperature. Under high fuel vaporization operating conditions, the vaporization characteristic of the fuel delivered to the engine 10 (FIG. 1) is altered by the temperature of the engine environment, reducing fuel volatility estimation accuracy.

FIG. 3 illustrates the change in the relationship between fuel volatility and engine speed following the period of time Tlmt after an engine startup. More specifically, the family of curves 310–330 illustrate the drop in engine speed for a constant fuel injection pulse width with decreasing fuel volatility which, during the period of time between Tcal and Tlmt, is determined to accurately reflect fuel volatility. However, for times greater than Tlmt following an engine cold start, the model becomes less informative as to fuel volatility. As such, fuel volatility estimation is not carried out in this embodiment beyond time Tlmt. However, in other embodiments within the scope of this invention in which the model is sufficiently sophisticated to account for the effect of increasing fuel temperature on fuel volatility, the period of time during which fuel volatility is estimated may be extended beyond that of this embodiment. Likewise, in embodiments within the scope of this invention in which initial engine speed transients are accounted for in the model of fuel volatility as a function of engine speed, the fuel volatility estimation may be carried out following an engine cold start prior to time Tcal.

Returning to FIG. 2, if the clock value is determined to exceed Tlmt at the step 218, the fuel volatility estimation and compensation operations of FIG. 2 are concluded by exiting the operations of FIG. 2 at a next step 260, to carry out other operations, such as relatively low priority background operations such as those described for step 216, which may be continuously repeated, or other conventional operations, such as operations to service pending interrupts. Returning to step 218, if the clock value is determined to be less than Tlmt, then signal Se is next sampled to provide a current indication of engine speed at a next step 219. Current engine speed is next compared to an engine speed range bounded by a calibrated lower speed $Se_{LOW}$ and a calibrated upper speed $Se_{HI}$. The engine speed range is determined through a conventional calibration process as a relatively small range of engine speeds around a target engine speed which represents acceptable engine speed control performance. Acceptable engine speed performance is performance which is assumed to properly comprehend current fuel volatility. The engine speed range is illustrated as range 304 of FIG. 3. In other words, if engine speed is within the engine speed range 304 bounded by $Se_{LOW}$ and $Se_{HI}$, then additional fuel volatility compensation is assumed to not currently be necessary, as the open-loop engine control under the current engine inlet air and injected fuel commands (with any currently-applied fuel volatility compensation) is substantially error free, and the operations proceed from the step 220 to the described step 260 to conclude the operations of FIG. 2.

Returning to step 220, if engine speed as indicated by signal Se is not within the engine speed range 304 (FIG. 3), then a speed deviation is present that may be caused by a change in fuel volatility away from a previously estimated and compensated volatility. Accordingly, fuel volatility estimation and compensation operations of steps 224–250 are carried out by first comparing engine speed to $Se_{HI}$ at a next step 224. If engine speed exceeds $Se_{HI}$ at the step 224, then presence of a high volatility fuel is assumed. The specific volatility of such fuel may, in an embodiment of this invention, be estimated directly as a function of a difference between current engine speed Se and a target engine speed for current engine operating conditions including current engine intake airflow rate, current engine load, and current engine temperature conditions. For example, a target engine speed may be generated as a function of such operating conditions through a conventional calibration procedure. The fuel volatility, whether generally estimated as high or low, or whether precisely estimated in the described manner, is next compensated by adjusting an air/fuel ratio control correction value in direction to vary engine cylinder fueling rate. Engine cylinder fueling rate is increased in the case of low volatility fuel, to compensate for the reduced vaporization characteristic thereof below a nominal vaporization characteristic, and is decreased in the case of high volatility fuel, to compensate for the increased vaporization characteristic thereof above the nominal characteristic.

Returning to step 224, if Se exceeds $Se_{HI}$, then $\delta_{FUEL}$ is next compared to an offset range bounded by $\delta_{LO}$ and $\delta_{HI}$ at a step 226. The offset range is provided as a range of compensation authority tolerated for the fuel volatility compensation of this embodiment. For example, in this embodiment, the range is established to allow, under nominal conditions, for an engine air/fuel ratio increase or an engine air/fuel ratio decrease of about 1.5. If $\delta_{FUEL}$ is within the offset range as determined at the step 226, then compensation authority is remaining, and $\delta_{FUEL}$ is next decremented at a step 228 to compensate for the high volatility fuel.

Following the step 228, the status of the exhaust sensor is examined. If the status is "active", for example as indicated by the range of voltage variation of the signal ES, or the current value of a timer initiated at the start of the current engine cycle, then an air/fuel ratio error is next generated at a step 232 as a difference between a predetermined air/fuel ratio, such as the stoichiometric ratio, and the current air/fuel ratio indicated by signal ES, following conventional processing and filtering of such signal. The air/fuel ratio error is applied to adjust the fuel offset value $\delta_{FUEL}$ in direction to drive the air/fuel ratio error toward zero, such as through decrementing or incrementing, as appropriate, $\delta_{FUEL}$ in the manner described for steps 228 and 244. Following modification of $\delta_{FUEL}$ at the step 234, or if the exhaust sensor was determined to not be active at the step 230, $\delta_{FUEL}$ is next stored at a step 236, and is applied to determine a current fueling command FUEL at a next step 238. In this embodiment, $\delta_{FUEL}$ is applied as an offset to the command FUEL, whereby a calibrated base fueling command is increased or decreased by the magnitude of $\delta_{FUEL}$, as described at step 208. The calibrated base fueling command may be generated in any suitable conventional manner, such as through an open-loop estimation of desired fueling as a function of sensed or estimated engine intake airflow rate. An increase or decrease in $\delta_{FUEL}$ of one count represents an increase or decrease in an injected fuel quantity during a single injection event that is designed to lead to, under nominal operating conditions, a corresponding increase or decrease in the engine air/fuel ratio of approximately 0.05, whereby engine speed is adjusted accordingly. The command FUEL is next output to the fuel controller 40 of FIG. 1 at a step 240 for timed application as a drive command of an appropriate form to a fuel injector of a next active engine cylinder, as described. Following the step 240, the described process, beginning at the step 212 is repeated, to provide for further estimation and compensation for fuel volatility variation during the current coldstart control procedure.

Returning to step 226, if $\delta_{FUEL}$ is not within the offset range such that further fuel offset compensation authority is not available, or if engine speed Se is determined at the step 220 to be within the desired target engine speed range bounded by $Se_{LOW}$ and $Se_{HI}$, or if the clock value read at the step 212 is determined, at the described step 218, to exceed the calibrated time period TLMT indicating that the period of open-loop operation following the coldstart is concluded, then the operations of FIG. 2 are exited at a next step 260, as described. Returning to step 224, if engine speed Se is determined to not exceed $Se_{HI}$, then a low fuel volatility condition is assumed to be present. The specific volatility of such fuel may, in an embodiment of this invention, be estimated directly as a function of a difference between current engine speed Se and a target engine speed for current engine operating conditions including current engine intake airflow rate, current engine load, and current engine temperature conditions. For example, a target engine speed may be generated as a function of such operating conditions through a conventional calibration procedure. The fuel volatility, whether generally estimated as high or low, or whether precisely estimated in the described manner, is next compensated, if authority remains for such compensation.

Specifically, if authority is available under the fueling offset $\delta_{FUEL}$ as determined at a next step 242 by comparing $\delta_{FUEL}$ to the offset range bounded by $\delta_{LO}$ and $\delta_{HI}$ in the manner described for the step 226, then $\delta_{FUEL}$ is next incremented at a step 244 to increase fueling to compensate for the relatively low estimated fuel volatility and to drive the underspeed error toward zero. After incrementing $\delta_{FUEL}$ at the step 244, the steps 230–240 are carried out in the manner described above, to correct $\delta_{FUEL}$, if necessary when the exhaust sensor is active, and to store and apply $\delta_{FUEL}$, whether corrected or not, in engine fueling control at step 240. After the step 240, certain operations of FIG. 2 beginning with step 212 are repeated in the manner described above.

The preferred embodiment is not intended to limit or restrict the invention since many modifications may be made through the exercise of ordinary skill in the art without departing from the scope of the invention.

The embodiments of the invention in which a property or privilege is claimed are described as follows:

1. An internal combustion engine air/fuel ratio control method, comprising the steps of:

sensing an engine startup operation;

sampling an input signal indicating engine speed following the engine startup operation;

estimating fuel volatility as a function of engine speed;

identifying the estimated fuel volatility as one of a high volatility and a low volatility;

modifying a correction value, by (a) increasing the correction value upon identifying the estimated fuel volatility as a low volatility, and (b) decreasing the correction value upon identifying the estimated fuel volatility as a high volatility;

correcting an air/fuel ratio control command as a function of the modified correction value; and controlling engine air/fuel ratio in accordance with the corrected air/fuel ratio control command to provide for accurate engine air/fuel ratio control over a range of fuel volatilities.

2. The method of claim 1 wherein the correction value is stored in memory and further including the step of updating the stored correction value with the modified correction value.

3. The method of claim 2 wherein the steps of sampling, estimating, identifying, modifying, correcting and controlling are repeated over a predetermined period following the engine startup operation.

4. The method of claim 3 wherein the predetermined period begins when engine speed stabilizes following the engine startup operation and the predetermined period concludes when predetermined closed-loop engine air/fuel ratio control conditions are determined to be present.

5. The method of claim 1 wherein the estimating step estimates fuel volatility as a function of engine speed by:

comparing engine speed to a target speed range; and determining a difference between the engine speed and the target engine speed range.

* * * * *